United States Patent [19]

Peterson

[11] Patent Number: 4,923,200

[45] Date of Patent: May 8, 1990

[54] APPARATUS FOR PLAYING CARD GAMES

[76] Inventor: Laverne Peterson, 98-501 Koauka Loop, Apt. A1104, Aiea, Hi. 96701

[21] Appl. No.: 303,429

[22] Filed: Jan. 30, 1989

Related U.S. Application Data

[63] Continuation-in-part of Ser. No. 130,997, Dec. 10, 1987, abandoned.

[51] Int. Cl.[5] ..... A63F 1/00

[52] U.S. Cl. ..... 273/309; 273/85 CP; 273/144 A; 273/149 R

[58] Field of Search ..... 273/85 CP, 144 R, 144 A, 273/144 B, 148 R, 148 A, 309, DIG. 27, 149 R

[56] References Cited

U.S. PATENT DOCUMENTS

| | | | |
|---|---|---|---|
| 1,989,258 | 1/1935 | Bair | 273/148 A |
| 2,026,682 | 1/1936 | Jeffries | 273/148 R |
| 2,087,221 | 7/1937 | MacClatchie et al. | 273/144 R |
| 2,383,860 | 8/1945 | Hickey | 273/148 R |
| 3,057,625 | 10/1962 | Livingston | 273/148 R |
| 3,371,932 | 3/1968 | Kranz | 273/144 R |
| 3,436,080 | 4/1969 | Schultz | 273/144 R X |
| 3,667,759 | 6/1972 | Barr | 273/DIG. 27 X |

*Primary Examiner*—Anton O. Oechsle
*Attorney, Agent, or Firm*—Richard C. Litman

[57] ABSTRACT

A card table for playing the game of bridge in which hard spherical elements are substituted for the ordinary plastic or cardboard playing cards. A set of fifty-two spherical elements have replicated thereon indicia of an ordinary deck of playing cards. The spherical elements are deployed within a shuffling and dispersing assembly which distributes the elements to each player. The table is equipped with holding trays to hold both the spherical elements in each player's hand; and the spherical elements as they are played out during the course of a game.

16 Claims, 6 Drawing Sheets

FIG. 5
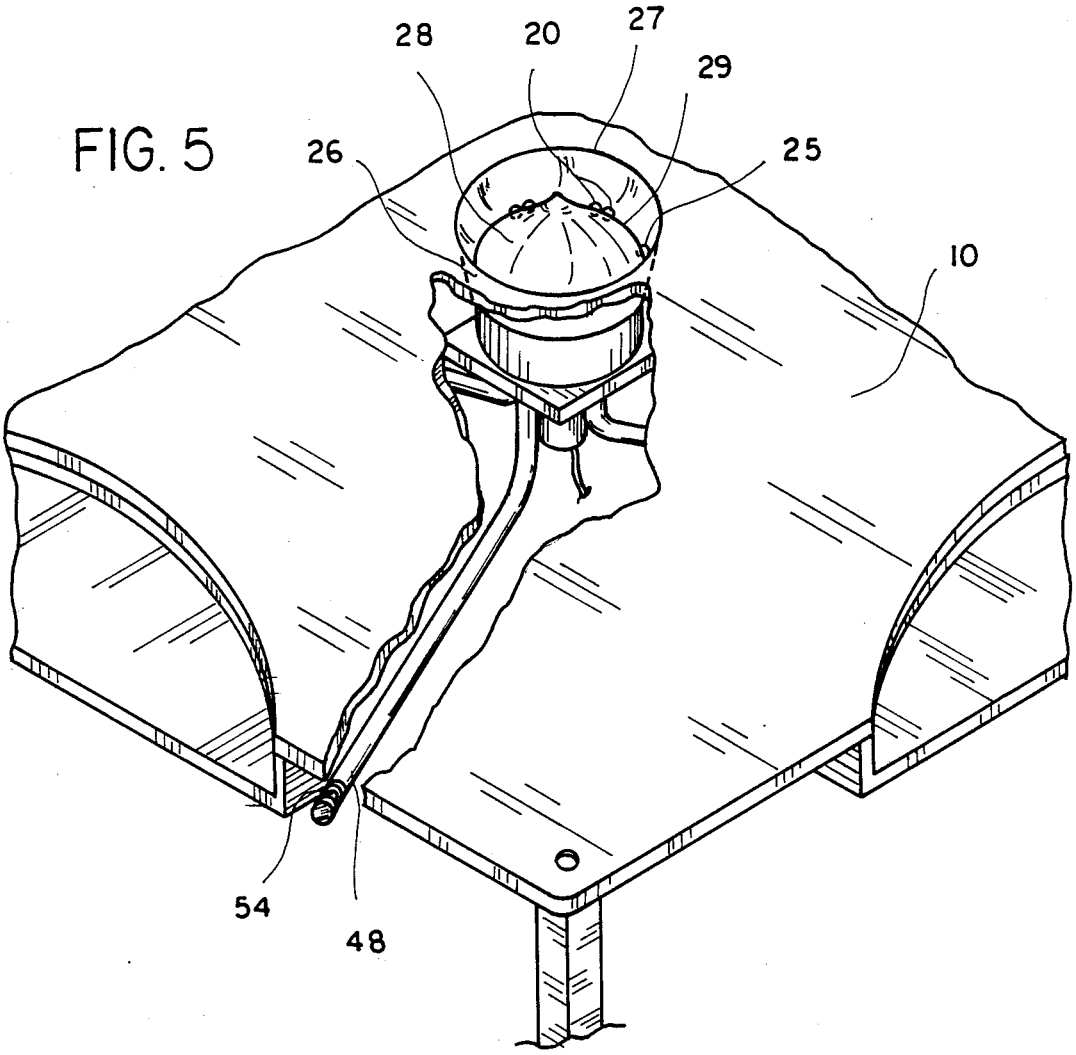
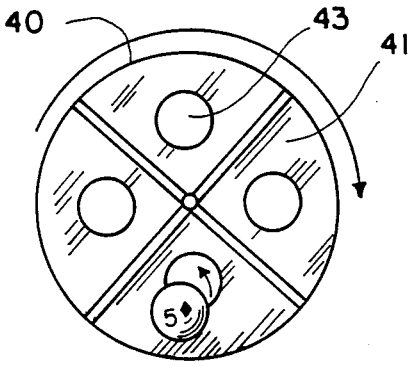
FIG. 6

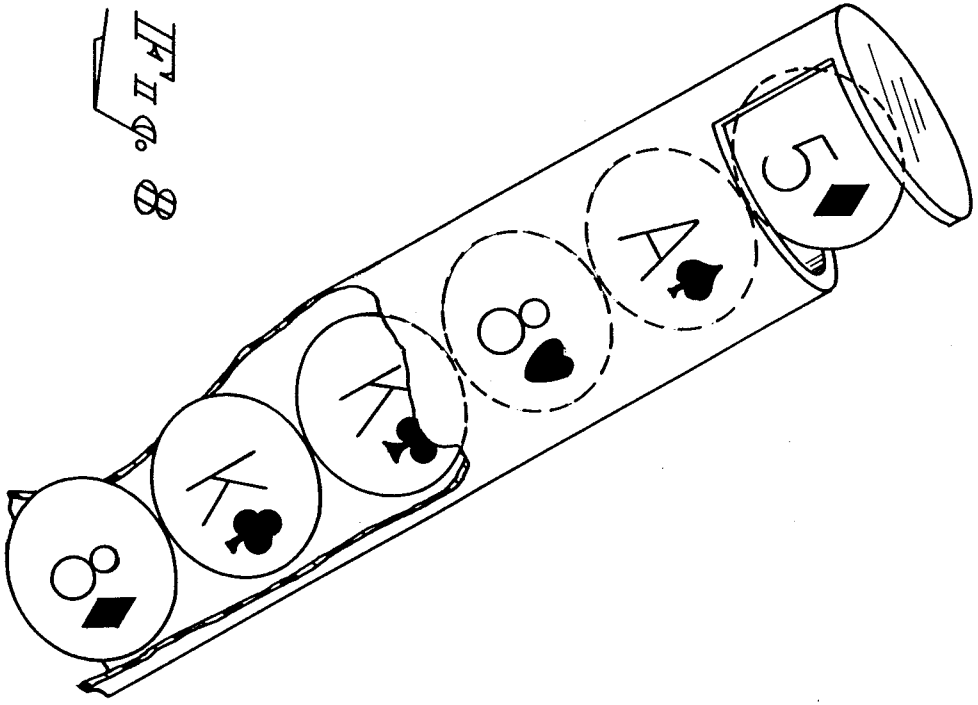
Fig. 8
Fig. 9
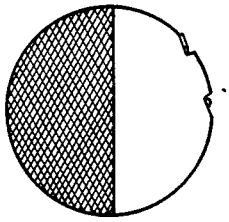
Fig. 10
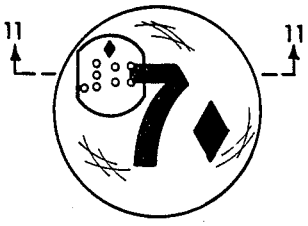
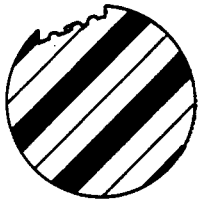
Fig. 11

APPARATUS FOR PLAYING CARD GAMES

CROSS-REFERENCE TO RELATED APPLICATION

This application is a continuation-in-part of application Ser. No. 130,997 filed Dec. 10, 1987, abandoned.

FIELD OF INVENTION

This invention relates to card games and, more particularly to an apparatus for playing card games such as the game of bridge.

BACKGROUND OF THE INVENTION

Professional and non-professionals alike engage in the activity of playing cards. Leagues, associations and clubs promote whatever specific game is the focal point of their activity and the numbers of people who routinely engage in competition in the playing of cards numbers in the millions.

Bridge is one such card game and is considered to be the most popular card game in the world with bridge clubs nationwide and in many foreign countries. The popularity of the game is immense and involves a friendly competition between two sets of players.

Four people play bridge. The person sitting opposite a given player is that person's partner and the nature of the game requires that four persons play at one time and the seating thereof is in partnerships of two with partners facing each other across the table. This invention relates to games of cards and especially to the game of bridge and is an apparatus for the substitution of the usual plastic cards with spherical elements and a means for randomizing the spherical elements and subsequently dealing the spherical elements out to each of the four players.

The apparatus further relates to a table structure that houses or contains the randomizing means and provides retaining means on the surface thereof for the display of the spherical elements and the organization of same within the format and rules of the game and also to the dispersal of the spherical elements to a player tray area in which only the player can see the specific elements that have been dealt; a planar surface of the table structure overlaying the player tray area prevents all other players from viewing the 'hand' of any of the other three players.

DESCRIPTION OF THE PRIOR ART

The following cited references are found to be exemplary of the U.S. prior art. The are:

| U.S. Pat. No. | Inventor |
|---|---|
| 4,601,470 | Kadota et al. |
| 3,853,324 | Reiner et al. |
| 3,203,699 | Pearson, Jr. |
| 2,383,860 | Hickey |
| 3,057,625 | Livingston |
| 2,026,682 | Jeffries |

U.S. Pat. No. 4,601,470, issued to Kadota et al, discloses a roulette gaming device having an electromagnetic apparatus for dispensing a ball, thereby providing an automated means for rotating or spinning the ball during the roulette game.

U.S. Pat. No. 3,853,324, to Reiner et al, teaches a construction of a combined game of chance and skill. The invention relates to a modified version of the game of bingo, wherein this form of the game utilizes an apparatus for dispensing indicating balls onto a rotating playing field and into two-sets of receiving sockets.

U.S. Pat. No. 3,203,699, issued to Pearson Jr. discloses an amusement device or game which utilized a rotating member operated by electrical means.

U.S. Pat. No. 2,383,860, issued to Hickey discloses a machine for playing card games using balls instead of cards and a method of shuffling and dispersing the balls.

U.S. Pat. No. 3,057,625, issued to Livingston discloses a game apparatus which shuffles and deals spherical game pieces.

U.S. Pat. No. 2,026,682, issued to Jeffries discloses an apparatus for playing games which shuffles and deals chips so that each player's hand will not be visible to the other players.

None of the above cited prior art references, whether taken singly or in combination discloses the specific details of the present invention so as to bear upon the claims herewith.

SUMMARY OF THE INVENTION

An object of the present invention is to provide a means for substituting spherical elements having indicia thereon identical to playing cards, for use in lieu of ordinary playing cards; and further to provide manifest advantages in the playing of card games by utilization of this substitution.

Another object is to provide an apparatus for shuffling or randomizing the spherical elements and for the division of a given quantity of them prior to each player retrieving the same; this operation taking the place of a dealer giving out each of the cards or elements.

Another object is to provide means for retrieval for the card-elements, after having been shuffled, to players, and a supplemental means for moving the collected, shuffled elements back to a player tray area.

DESCRIPTION OF THE DRAWINGS

FIG. 5 is a cutaway view of the apparatus illustrating its placement in the table.

FIG. 6 is a plan view of the upper dispersing element showing the openings through which the spherical elements fall, further illustrating the rotational nature of the upper dispersing element.

FIG. 8 is a view of a receiving tube member and illustrating the stacked or in-line nature of the spherical elements within; the length and interior volume of each of the receiving tube members being of a character sufficient to contain only a given number of spherical elements; i.e., thirteen in the game of bridge.

FIGS. 9, 10 and 11, illustrate a raised relief on the spherical elements to assist the visually impaired.

DESCRIPTION OF THE PREFERRED EMBODIMENT

Figure 4:
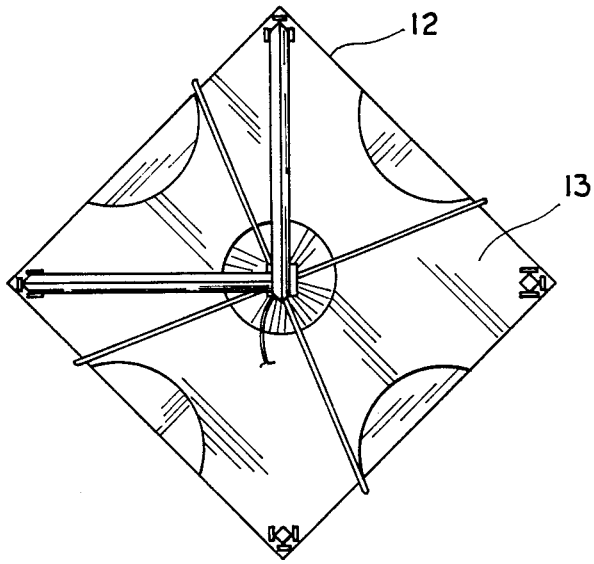
FIG. 4 is a plan view illustrating the folding legs that are pivotably attached to the table.

Referring now to the figures in which like numbers refer to like elements throughout, game apparatus 10 includes a table 12. Table 12 has four legs 12', 12'', 13, and 13', the latter of which is not shown but located as indicated on FIG. 4, that are foldable to permit the table to be conveniently carried to a patio or game room and easily set up.

In the preferred embodiment of the present invention a card table 12 for playing the game of bridge is utilized in which hard, spherical elements are substituted for use in lieu of the ordinary plastic or cardboard playing cards. A set of fifty-two spherical elements have replicated thereon indicia of an ordinary deck of playing cards. Each one of the set having indicia of one playing card corresponding to that of a deck of cards.

Figure 2:
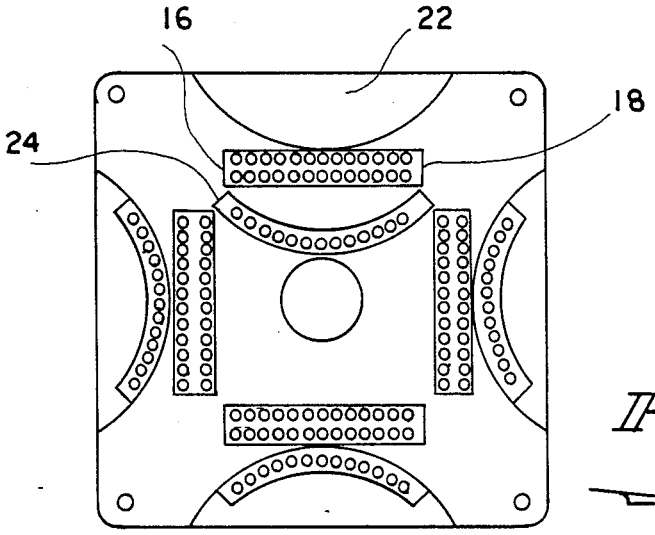
FIG. 2 is a top plan view of table illustrating its configuration after bidding, reflective that the player in the south position has received the bid and the north position is designated dummy, in accordance with the method of playing bridge.

An upper planar surface 14 on table 12 has holding means such as place mats 16 with orifices 18 shown in a typical arrangement in FIG. 2 for retaining spherical elements 20 that are substituted in the use of the novel game apparatus device 10 for plastic playing cards. Holding means 16 are arrayed in an organization appropriate to the nature of the game of cards being played. Holding means 16 lay flat on planar surface 14 and may, optionally, have magnetic or any suitable adhering means to maintain a close contact with planar surface 14. Spherical elements are placed within holding means thereby being secured against the wind or any other elements of instability.

Figure 1:
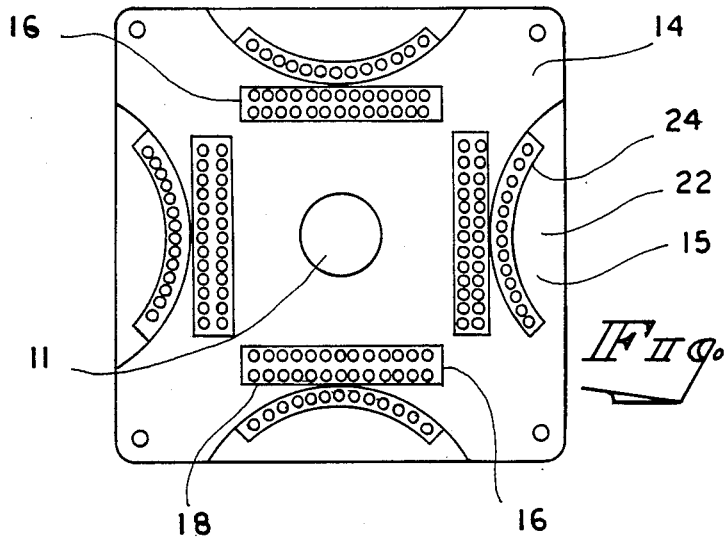
FIG. 1 is a top plan view of the table illustrating its configuration while the players are bidding, and showing the planar surface of the table and an arrangement of place mat style holding means for retaining spherical elements that are used in lieu of plastic cards in this apparatus.

A planar surface 15 overlays a plurality of recessed areas 22 that prevent other players from viewing the spherical elements 20 that are held within an individual holding tray 24 as shown in FIG. 1. The planar surface may consist of an acrylic resin such as PLEXIGLASS manufactured by Rohm & Haas or some other transparent material so that a player can view his hand.

The individual holding tray 24 can also be removed from the recessed area 22 and placed on the table when a player is in the position of "dummy" in the game of bridge, as shown in FIG. 2.

Figure 3:
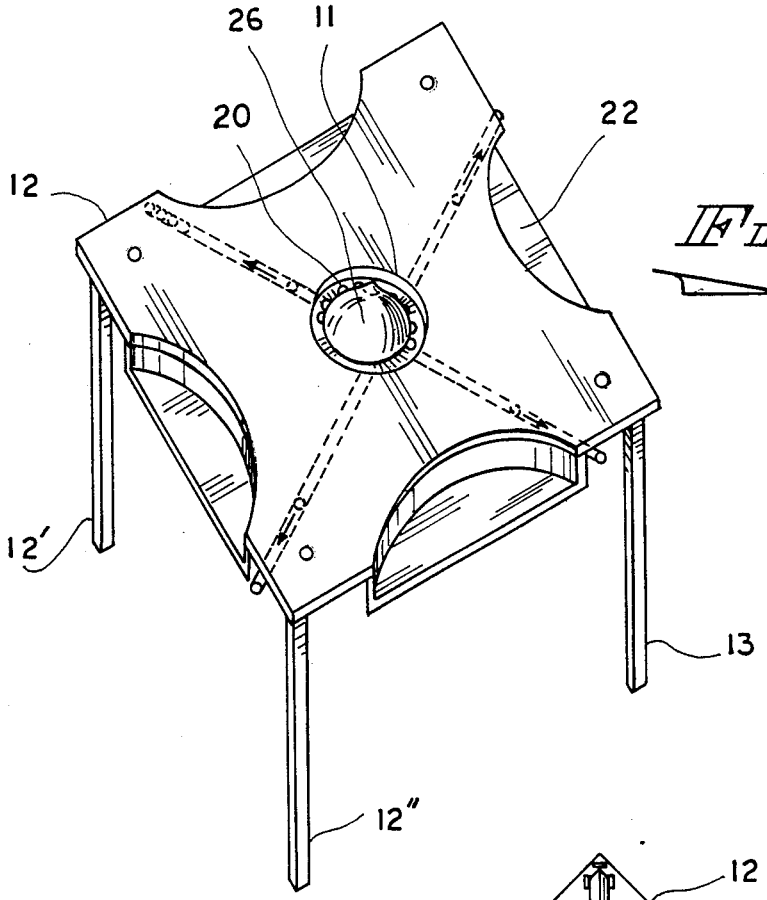
FIG. 3 is an isometric view of the table apparatus illustrating its lightweight construction.

Table 12 of apparatus 10 has a circular aperture 11 in the center over which is removably affixed thereto a receiving assembly generally indicated at 26, as illustrated in FIG. 3.

Now referring to FIG. 5. receiving assembly 26 consists of a bowl-shaped receptacle 27 containing a dome shaped portion 28 with a channel 29 encircling the dome-shaped portion between its base and the bowl-shaped receptacle 27. The dome-shaped portion 28 is disposed in the bowl-shaped receptacle 27 but is not attached and rotates independently of the bowl-shaped receptacle. The perimeter of the base of the dome-shaped portion 28 is greater than the inner perimeter of the channel 29. The upper side of the channel is concave, and of a width substantially the same as that of the spherical elements 20. The receiving assembly 26 contains an aperture 25 along the channel defined by the space between the outer edge of the dome shaped portion 28 and the receptacle 27, having a diameter slightly larger than that of the spherical elements. The particular shape of the receiving assembly causes a spherical element 20 dropped into the receiving assembly 26 to spin due to the rotating dome shaped portion 28, and roll due to gravity towards the channel 29 of the receiving assembly 26 causing the spherical element to fall through aperture 25. Multiple spherical elements dropped into the receiving assembly wall fall through aperture 25 in a random order thereby beginning a shuffling process.

Figure 7:
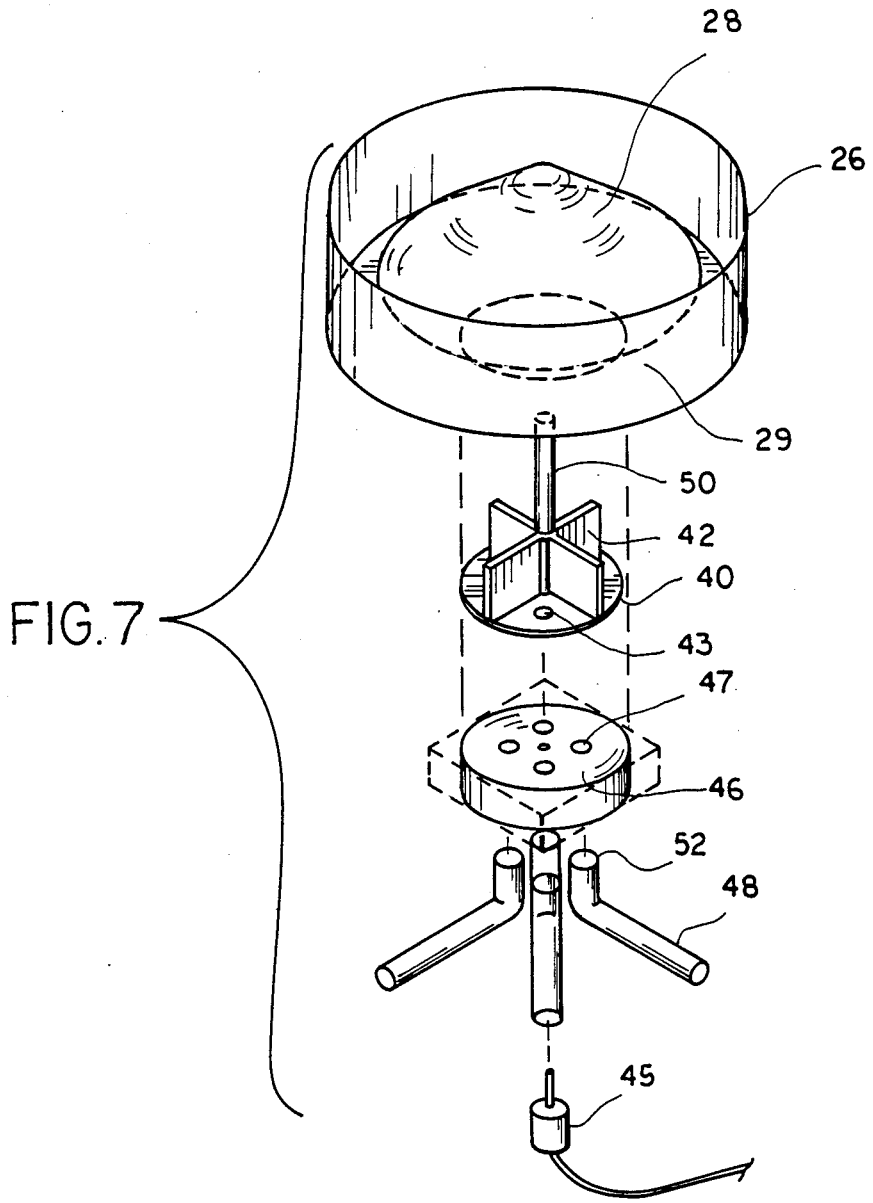
FIG. 7 is an exploded view of the preferred embodiment of the invention, showing the major components or members of the operating apparatus and more particularly the elements for receiving the spherical elements and feeding them to a vaned device and thereafter to and within a dispensing device for randomizing and dispersal to a plurality of receiving tube members.

As spherical elements 20 fall through aperture 25 they fall randomly into a rotating upper dispersing element 40 shown in FIGS. 6 and 7. which has disposed on the upper surface thereof a plurality of vanes 42 disposed as shown in FIG. 6 as a cross dividing a planar disc 41 into four quadrants. In order to contain the spherical elements in the separate quadrants the vertical height of the vanes 42 from the upper surface of the planar disc 42 is substantially greater than the diameter of the spherical elements 20.

As illustrated in the fragmentary view of FIG. 7. the upper dispersing element 40 of the assembly which includes the vaned planar disc, has a perimeter substantially equal to that of the outer perimeter of the channel 29 whereby the vanes 42 project up under the dome-shaped portion 28 of the receiving assembly 26. The upper dispersing element 40 has four apertures 43, corresponding to the four sections created by the vanes, which are shown in FIG. 6 but which are not shown in FIG. 7 in view of the fact that these would be disposed behind the blade portion of element 40. As spherical elements 20 are rotated in the upper dispersing element 40, they are further shuffled and fall through one of the apertures to a lower dispersing element 46.

In FIG. 7, lower dispersing element 46 consists of a stationary planar disc having four apertures 47 corresponding in placement to the four apertures 43 in the upper dispersing element 40. Attached through each aperture 47, abutting the lower face of the upper dispersing element 40 is a receiving tube 48. The spherical elements 20 fall due to gravity into receiving tubes 48; each such receiving tube 48 having a capacity for receiving and storing therein a predetermined number or quantity of, for example, as with the case of a bridge game, thirteen spherical elements 20, so that as each such tube is filled, not necessarily in sequence but as the spherical elements are captured and dropped through the holes, the excess spherical elements 20 are routed to another of the receiving tubes. This results in each of the receiving tubes ultimately having the correct number of spherical elements 20, therein for unloading of the tubes by the bridge player and transferred to the spherical element holding trays 24 of FIGS. 1 and 2 for playing of a round or a subsequent round of bridge.

The receiving assembly, upper dispersing element and lower dispersing element are stacked one upon the other and are rotatably attached through a center rod running vertically through the center point of each component. A small electric motor 45 drives the upper dispersing element 40, and the dome shaped portion 28 of the receiving assembly 26 through use of the center rod 50 as illustrated in FIGS. 7 and 12.

Now referring to FIG. 7. receiving tubes 48 are provided with a disengaging arrangement or capability at 52 where, for example, the receiving end of a tube is preferably frictionally held in place and is pulled out of the holes on the bottom side of the element 46 and dumped into the hands of the respective players or by any other desired means. Thus the receiving tubes 48 may individually be removed by the player in the position for use of that particular group of spherical elements disposed in his or her tube.

As seen in FIG. 8, the spherical elements 20 may also be removed by the player through use of an aperture 53 located at 54.

Figure 12:
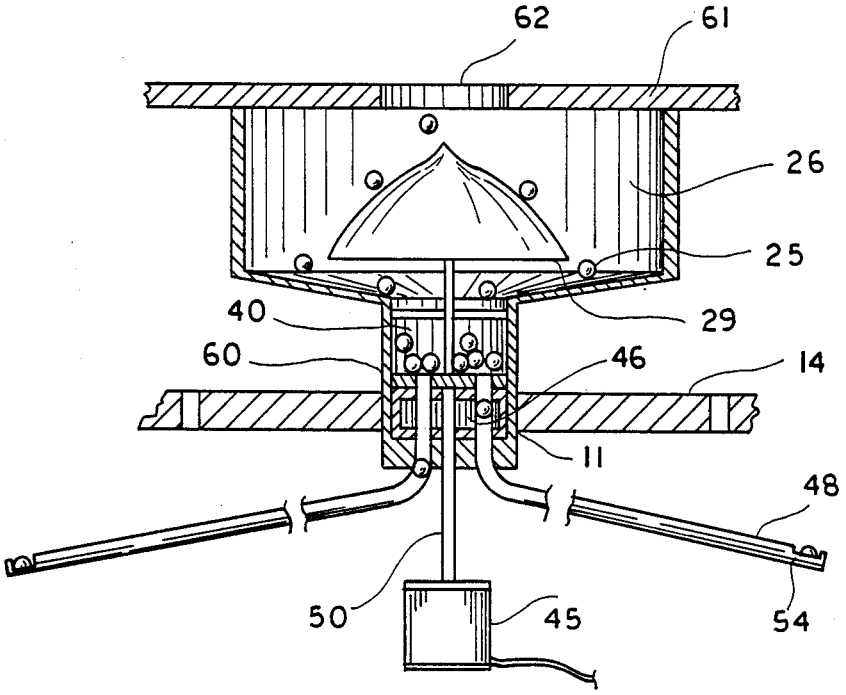
FIG. 12 is a cross-sectional view of the invention showing the dispersing element and tube members.

Referring now to FIG. 12, the lower dispersing element 46, upper dispersing element 40 and receiving assembly 26 are encased in a covering 60. The covering 60 is attached to either the upper or lower surface of table 10, and the inner surface of aperture 11 so as to retain the lower dispersing element 46 level with the table while allowing the receiving tubes to extend through the aperture 11 in the table. The attachment may incorporate screws or bolts projecting through holes therein and into the table top or in the alternative toggle clamps or turn buttons spaced from the bottom side of the table 10 as desired and the choice as to which fastening arrangements will be apparent and selected as desired by those skilled in the art. Above the receiving assembly 26 is a lid 61, containing an aperture 62 centered thereon. Spherical elements 20 are dropped through aperture 62 to start the shuffling and dispersing process.

Spherical elements 20 may, optionally have raised indicia as shown in FIGS. 9 to 11 to allow the visually impaired to play bridge with others, both visually impaired and non-visually impaired.

The foregoing is considered as illustrative only of the principles of the invention, Further, since numerous modifications and changes will readily occur to those skilled in the art, it is not desired to limit the invention to the exact construction and operation shown and described, and accordingly, all suitable modifications and equivalents, which may be resorted to, fall within the scope of the invention are intended to be protected.

I claim:

1. A table and related apparatus for playing a game analogous to a game of cards comprising:

a plurality of spherical elements that have indicia thereon of a character corresponding to playing cards;

said plurality of spherical elements being analogous in use to a deck of playing cards;

said table having holding means deployed thereon for retaining said spherical elements in a plurality of playing positions;

said table having recessed areas containing individual holding trays, said individual holding trays being capable of containing no more than thirteen spherical elements;

said table having stacked thereon an assembly for receiving said spherical elements, and means for randomizing and dispersing said spherical elements;

said receiving assembly includes an aperture through which spherical elements can fall;

said aperture leading to said randomizing and dispersing means which include upper dispersing means and lower dispersing means, both said upper and lower dispersing means being circular and having substantially the same diameter;

said upper dispersing means are rotatable and have disposed thereon vanes whereby the upper surface is divided into four substantially equal quadrants each having an aperture disposed thereon; and said lower dispersing means are fixed and have disposed thereon four apertures each corresponding to a said aperture on said upper dispersing means, each of said four apertures leading to a cylindrical receiving tube whereby spherical elements can be dispersed to said plurality of playing positions.

2. A table and related apparatus for playing a game as recited in claim 1 wherein:

said receiving tubes having an internal diameter substantially the same as said spherical elements, each said receiving tube being capable of containing no more than thirteen spherical elements;

said receiving tubes also being removably attached to said lower dispersing means whereby players of the game may retrieve said spherical elements from said receiving tubes subsequent to the completion of the randomization and dispersement function of the apparatus.

3. A table and related apparatus for playing a game of cards as recited in claim 1 wherein said spherical elements have raised or embossed indicia whereby the visually impaired may play the game of cards.

4. A table and related apparatus for playing a game of cards as recited in claim 1 wherein said table has folding legs deployed therewith whereby said table may be conveniently stored.

5. A table and related apparatus for playing a game of cards as recited in claim 1 wherein a planar surface overlies said recessed areas, said planar surface comprising a transparent material whereby players may view their respective spherical elements in their respective said individual holding tray.

6. A table and related apparatus for playing a game of cards as recited in claim 1 wherein players begin a new game by dropping spherical elements into said receiving assembly.

7. A table and related apparatus for playing a game of cards as recited in claim 1 wherein said receiving tubes are supported by a frame under said table.

8. A table and related apparatus for playing a game of cards as recited in claim 1 wherein said holding means includes adhering means.

9. A table and related apparatus for playing a game of cards as recited in claim 1 wherein said card game is the game of bridge.

10. A table and related apparatus for playing a game of cards as recited in claim 1 wherein:

said upper dispersing means includes a perimeter, an upper surface and a lower surface;

said receiving assembly includes a bowl shaped receptacle containing a dome shaped portion having a concentric channel along the interior of said bowl shaped receptacle and the exterior perimeter of said dome shaped portion, said channel having an upper concave side and a lower convex side and said aperture disposed thereon;

said dome shaped portion rotatable independently of said bowl shaped receptacle;

said perimeter of said upper dispersing means being substantially equal to the outer perimeter of said channel and disposed beneath said lower convex side of said channel, whereby said vanes on said upper dispersing means are enclosed under said dome shaped portion of said receiving assembly.

11. A table and related apparatus for playing a game of cards as recited in claim 10 wherein said upper dispersing means comprises a substantially planar disc having said vanes perpendicular to said planar disc, said vanes having a height above said planar disc substantially greater than the diameter of said spherical elements.

12. A table and related apparatus for playing a game of cards as recited in claim 10 wherein an electric motor rotates said upper dispersing element.

13. A table and related apparatus for playing a game of cards as recited in claim 12 wherein:

players begin a new game by dropping spherical elements into said receiving assembly;

said spherical elements are randomized by the rotational movement of said receiving assembly and said upper dispersing means, said spherical elements falling due to gravity from said bowl shaped portion of said receiving assembly into said channel of said receiving assembly, wherein said spherical elements pass singly through said aperture into a random quadrant of said upper receiving means.

14. A table and related apparatus for playing a game of cards as recited in claim 13 wherein said table has folding legs deployed therewith whereby said table may be conveniently stored.

15. A table and related apparatus for playing a game of cards as recited in claim 13 wherein said spherical elements fall through said apertures in said upper dispersing means to said lower dispersing means wherein said spherical elements fall through said apertures in said lower dispersing means thereby into said receiving tubes.

16. A table and related apparatus for playing a game of cards as recited in claim 13 wherein said receiving means having a cover with a perimeter substantially equal in size to the upper perimeter of said bowl shaped receptacle, said cover having an aperture centered thereon through which spherical elements can be dropped.

* * * * *